US005642842A

United States Patent [19]

Taras

[11] Patent Number: 5,642,842

[45] Date of Patent: Jul. 1, 1997

[54] CONVERTIBLE SLING/WAISTBELT FOR CARRYING IN-LINE SKATES, BOOTS, AND SHOES

[75] Inventor: Curt Michael Taras, Sacramento, Calif.

[73] Assignee: Spaztech Designs, Antelope, Calif.

[21] Appl. No.: 585,644

[22] Filed: Jan. 16, 1996

[51] Int. Cl.[6] ..... A45F 3/14

[52] U.S. Cl. ..... 224/250; 224/663; 224/603; 224/258

[58] Field of Search ..... 224/650, 651, 224/600, 601, 602, 603, 604, 606, 623, 624, 625, 627, 637, 638, 639, 640, 641, 645, 646, 647, 648, 676, 250, 257, 258, 917; 294/154, 155, 157, 159, 146, 147

[56] References Cited

U.S. PATENT DOCUMENTS

| | | | |
|---|---|---|---|
| 2,109,232 | 2/1938 | Hoyt | 224/625 |
| 3,369,723 | 2/1968 | Saari et al. | 224/250 |
| 4,251,016 | 2/1981 | O'Rafferty et al. | 224/250 |
| 4,629,103 | 12/1986 | Miller | 224/257 |
| 5,277,347 | 1/1994 | Savard | 224/250 |
| 5,318,209 | 6/1994 | Rader | 224/250 |

FOREIGN PATENT DOCUMENTS

| | | | |
|---|---|---|---|
| 4801 | 3/1901 | United Kingdom | 224/214 |

*Primary Examiner*—Henry J. Recla
*Assistant Examiner*—Gregory M. Vidovich

[57] ABSTRACT

A lightweight, compact carrier for carrying shoes and large boots, particularly in-line skates, in a side-by-side relation. The carrier may be selectively hung from the shoulder of a person when holding boots, skates or shoes or it can be worn about the waist of the person when carrying shoes. The carrier includes a strap assembly which wraps around the footwear in connection with a large strap which serves as a shoulder strap/waist belt. The footwear strap assembly is composed of a thin strap arranged in a figure eight with the center of the figure eight running through a patch with four cut slots. This patch is attached to the large strap. One of the loops of the figure eight is a closed loop that wraps around a toe portion of the footwear and the other loop of the figure eight includes free ends of the strap assembly defining an open loop that wraps around the ankle portion of the footwear wherein the free ends include an adjustable fastener, preferably a friction buckle fastener.

5 Claims, 2 Drawing Sheets

CONVERTIBLE SLING/WAISTBELT FOR CARRYING IN-LINE SKATES, BOOTS, AND SHOES

DESCRIPTION

1. Field of the Invention

This invention relates to article carriers, and more specifically to a carrier for holding and carrying a pair of shoes, boots, or skates.

2. Description of The Background Art

In-line skates are large, stiff, and include a multi-wheeled chassis extending from the bottom. These characteristics make them difficult to carry without a suitable carrier device. In-line skates are required to be carded often. Specifically, they need to be carried for safety reasons when encountering steps or rough terrain and for regulatory reasons when entering facilities that do not allow the wearing of skates. Therefore, a carrier that comfortably and securely holds in-line skates is needed. In addition, in these situations users need to have walking footwear present to change into. The ideal carrier should therefore be able to carry walking footwear comfortably and securely when skating.

Available carriers are mainly ski boot carriers adapted for the purpose of carrying in-line skates. These carders do not carry in-line skates as comfortably or securely as the present invention. The available carriers also can not be used to carry walking footwear.

One such available boot carrier includes a loop of cord attached to the center of a small handle. To carry a pair of boots or skates the ankle buckles of each are passed through the loop of cord and then fastened. Boots and skates are awkward to carry with this carrier because they dangle from and rotate about the cord knocking in to each other and the person carrying them.

Next, other boot carriers employ frames or other devices of metal or rigid plastic to which the boots or skates clamp on to. A carrying strap or handle then extends from the handle. Users of such ridged devices find they are difficult to store on their person when not in use. Furthermore, these types of boot carders do not allow for the carrying of walking footwear.

Finally, another type of boot/skate carrier provides a strap that attaches to each boot or skate individually. Each end of the strap attaches to one boot or skate. The strap is then slung over the shoulder of the user with one boot or skate in front of the user and the other in back. This type of carrier allows the carded items to dangle freely, apart from each other, in a non-secure manner. This manner creates the possibility of the carried items to swing out and knock back into the user or fall off the shoulder completely. And again, this type of carrier also does not adapt to carry walking footwear.

Therefore, the object of the present invention is to provide an improved sling for supporting, holding, and carrying a pair of skates or boots in juxtaposed relation which are pointed in the same direction as the user. Another object of the invention is to provide a sling for holding and carrying a pair of shoes or sandals. This sling can be carried over the shoulder or converted into a belt to be worn securely around the waist. Lastly, the final goals of the invention are for it to be easy to use, light in weight, compact in size, simple in design, and inexpensive to manufacture.

SUMMARY OF THE INVENTION

To achieve the aforementioned objects, this article carrier comprises: a sling having a first strap forming an open loop with a friction buckle fastener allowing the strap to be carried over the shoulder or worn around the waist. A second strap, forming a figure eight, the top of the eight being a closed loop that wraps around the toes of a pair of skates or boots placed side by side. The lower half of the figure eight is an open loop that wraps around the ankles of a pair of boots or skates and is fastened with a friction buckle fastener. At the center of the figure eight, where the figure eight crosses, the second strap runs freely through a patch with four slots in it. This patch is attached to the first strap with the first strap running through the loops of the figure eight of the second strap and underneath the four slot center patch.

When carded, the carrier forms three adjustable loops that are in three separate planes all normal to each other. This allows a pair of boots or skates to be supported, held, and carried in a juxtaposed relation and pointed in the same direction as the user so they lie comfortably alongside the users body. The three loops are adjustable, accommodating a wide range of sizes in both footwear and the user.

DESCRIPTION OF THE PREFERRED EMBODIMENT

Figure 1:
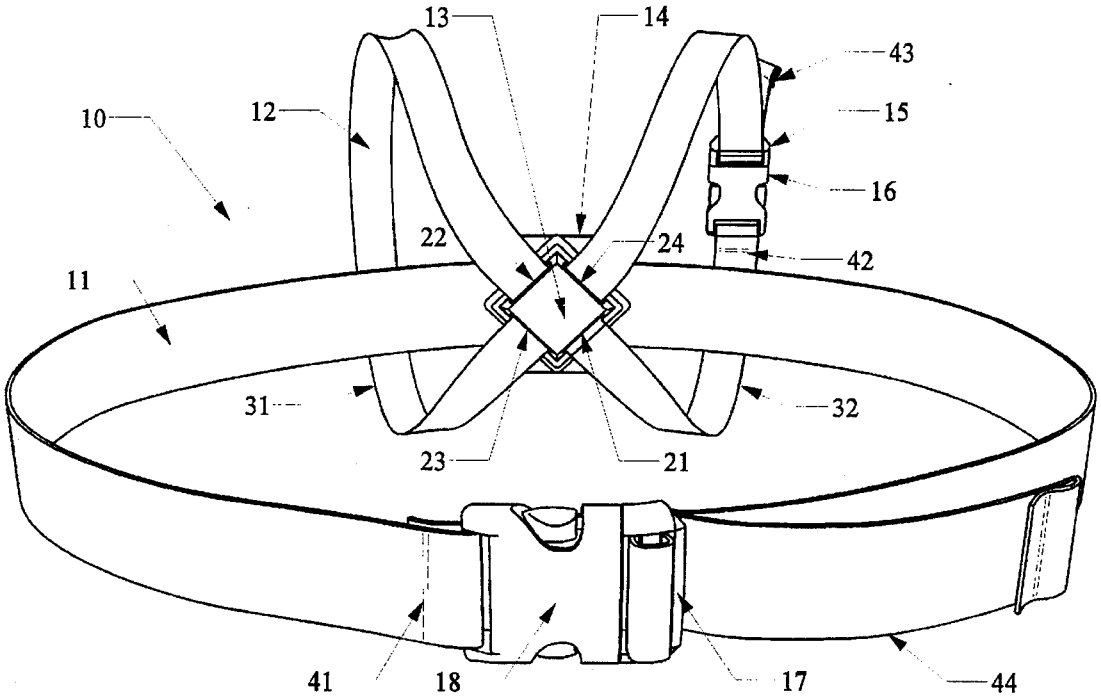
FIG. 1 is a top perspective view of the carrier device in accordance with the invention, the device is shown in closed configuration.
Figure 2:
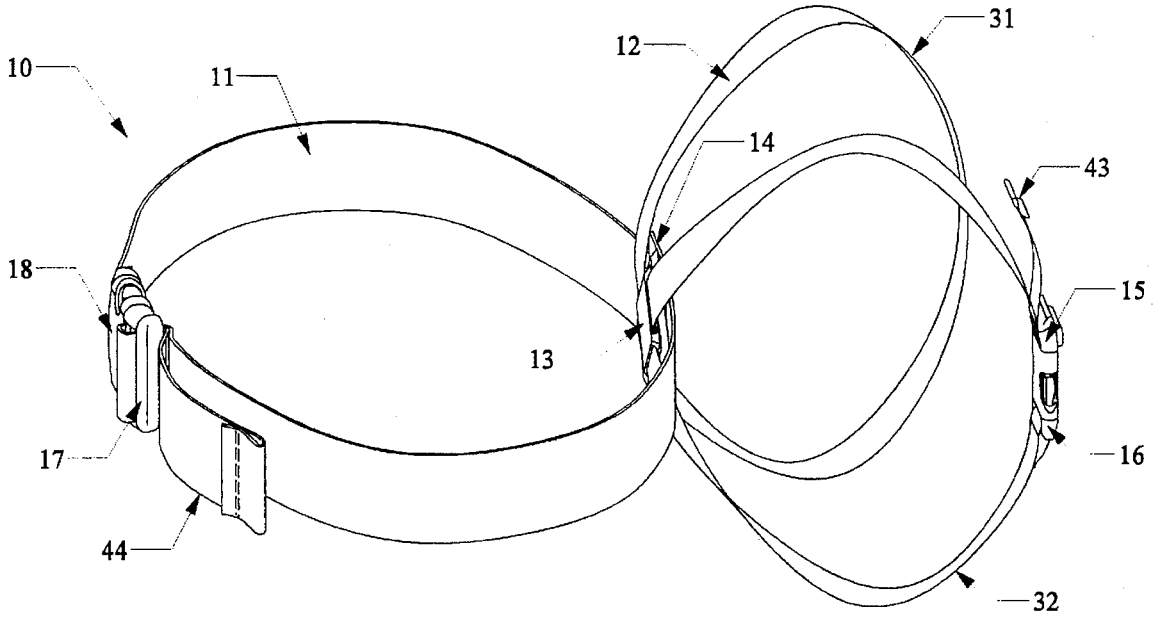
FIG. 2 is a side perspective view of the invention in closed configuration.
Figure 3:
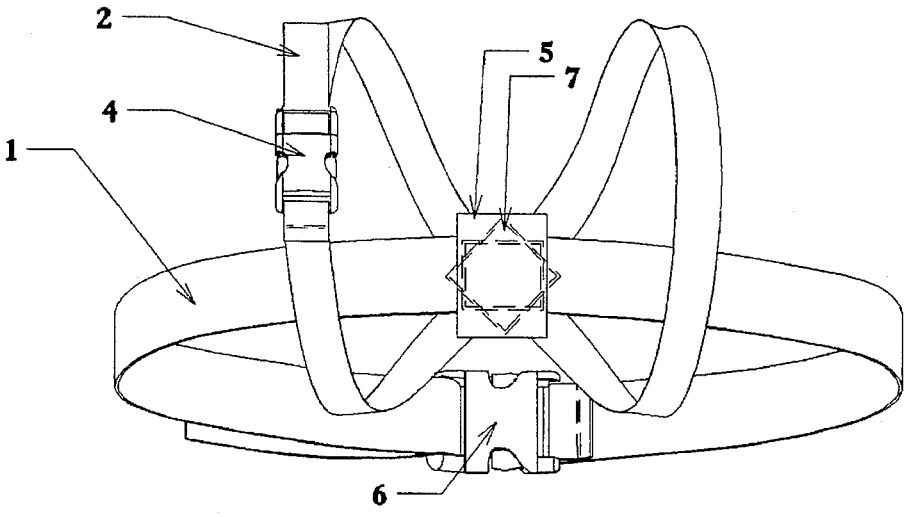
FIG. 3 is a bottom perspective view of the invention in closed configuration.

Referring now to the drawings for a more detailed description of the invention, components are identified by numbers which are the same throughout the several views. FIGS. 1, 2, and 3 illustrate a sling 10 designed to securely hold footwear that can be carried over the shoulder when holding rigid skates or boots and worn around the waist when holding smaller flexible footwear. The sling 10 is comprised of a wide strap 11 made of flexible material such as webbing. The wide strap 11 is typically 5.08 centimeters (2 inches) wide and 168 centimeters (66 inches) long. At one end of the wide strap 11 is the male piece 17 of a large friction buckle fastener and at the other end is the corresponding female piece 18. A closed loop is formed from the main strap 11 by connecting the male piece 17 and the female piece 18 of the large friction buckle fastener. When closed, the loop formed by the strap 11 is adjustable in size. This allows the main strap 11 to be tightened around the waist of a user as in FIG. 4. Size adjustments in the main strap 11 also allow the carded item to be raised or lowered when slung over the shoulder as in FIG. 5. This gives the user the ability to select a comfortable sling length.

The female piece 18 of the friction buckle fastener is securely connected to the wide strap 11 by a sewn bend 41 in the wide strap 11 material. The male piece 17 of the friction buckle fastener is attached to the free end of the wide strap 11 in a way that allows it to move along the length of the wide strap 11 by adjusting the length of slack 44 extending from the buckle. The free end of the wide strap 11 is threaded through the ladderlock portion of the male piece 17 of the friction buckle fastener. This arrangement provides an open loop with one end rigid and the other end adjustable.

On the wide strap 11, about 46 centimeters (18 inches) from the female piece 18 is a patch 13 with four cut slots 21, 22, 23, and 24. Typically, the patch 13 is a 5.08 centimeter by 5.08 centimeter (2 inch by 2 inch) square of thermoplastic material. The slots 21, 22, 23, and 24 are cut to accept 2.54 centimeter (1 inch) webbing and are arranged as a square corresponding to the orientation of the patch 13. The patch 13 is stitched to the inside of the closed loop formed by the wide strap 11 when both ends 17 and 18 of the buckle are connected. The patch 13 is aligned so two corners point longitudinally with the wide strap 11. As shown in FIG. 3, the remaining two corners overlap the wide strap 11; thus, a piece of webbing 14 is placed underneath the patch 13 as reinforcing material for stitching the overlapping patch corners.

A narrow strap 12 runs through the cut slots 21, 22, 23, and 24 of the patch 13. This connects the narrow strap 12 to the wide strap 11 and dictates their orientation to each other. The orientation of the straps is fundamental to the invention.

The narrow strap 12 is typically 2.54 centimeters (1 inch) wide, 121.9 centimeters (48 inches) long, and made of flexible webbing material. At one end of the narrow strap 12 is the male piece 15 of a small friction buckle fastener and at the other end is the corresponding female piece 16. The position of the male piece 15 along the narrow strap 12 is adjustable. This allows adjustments in the size of a loop of webbing formed by connecting the pieces 15 and 16 of the small friction buckle fastener. The female piece 16 is securely connected to the narrow strap 12 by a sewn bend 42 in the narrow strap 12 material.

The orientation of the straps to each other is described by following the path of the narrow strap 12 with both friction buckle fasteners connected. Starting at the female piece 16, the narrow strap 12 runs from the female piece 16, curves up, and runs through the loop formed by the wide strap 11. The narrow strap 12 then enters the patch 13 through slot 21 and exits through slot 22. Upon exiting the patch 13, the narrow strap 12 curves down, running out of the loop formed by the wide strap 11, then curves up running back through the said loop a second time. As the narrow strap 12 runs through the said loop the second time, it enters the patch 13 through slot 23 and exits through slot 24 crossing its own path perpendicularly. The narrow strap 12 then curves down and out of the loop formed by wide strap 11 and passes through the ladderlock portion of the male piece 15.

In this orientation the narrow strap 12 forms a figure eight. At the center of the figure eight, the narrow strap 12 runs freely through slots 21, 22, 23, and 24 of patch 13. Wide strap 11 runs though the loops and under the center of the figure eight formed by narrow strap 12. Patch 13 is stitched to the wide strap 11 thereby holding straps 11 and 12 together and in position.

When skates or boots are placed in the sling 10, the buckleless loop 31 of the figure eight is a closed loop that wraps around the toes of a pair of skates or boots which are placed side by side. The buckled loop 32 of the figure eight is an open loop that wraps around the ankles of a pair of boots or skates and is fastened by connecting the male piece 15 with the female piece 16 of the friction buckle fastener. Adjustments in the circumference of both loops 31 and 32 are made by changing the length of slack webbing 43 extending from the male piece 15. The entire sling 10 can then be picked up and carried by hanging the wide strap 11 on the shoulder of a user as shown in FIG. 5.

Figure 5:
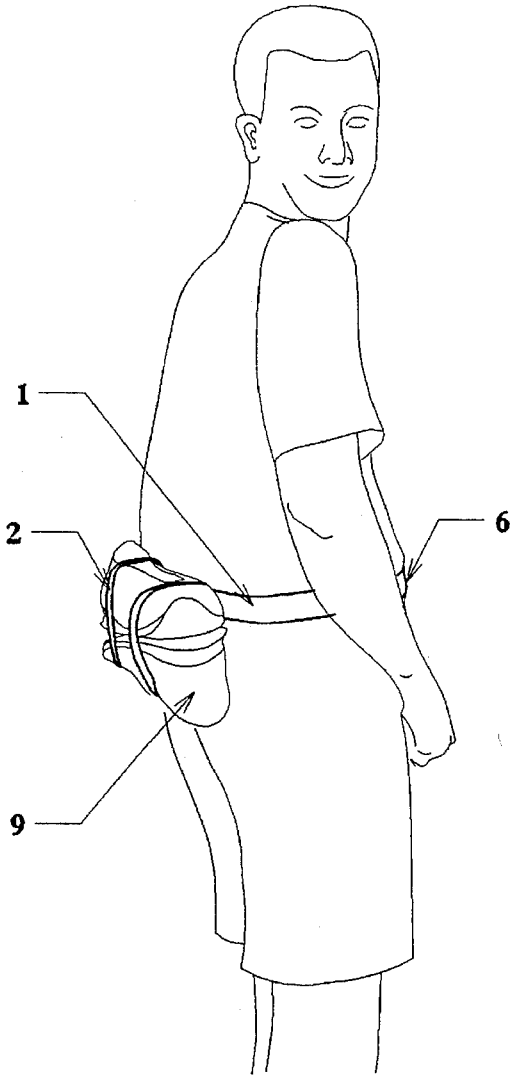
FIG. 5 illustrates the use of the invention as a shoulder sling carrying a pair of in-line skates.

When carried as illustrated in FIG. 5, the carrier forms three adjustable loops that are in three separate planes that are generally normal to each other. This allows a pair of boots or skates to be supported, held, and carried in a juxtaposed relation and pointed in the same direction as the user so they lie comfortably alongside the users body. The three loops are adjustable, accommodating a wide range of sizes in both footwear and the user.

Figure 4:
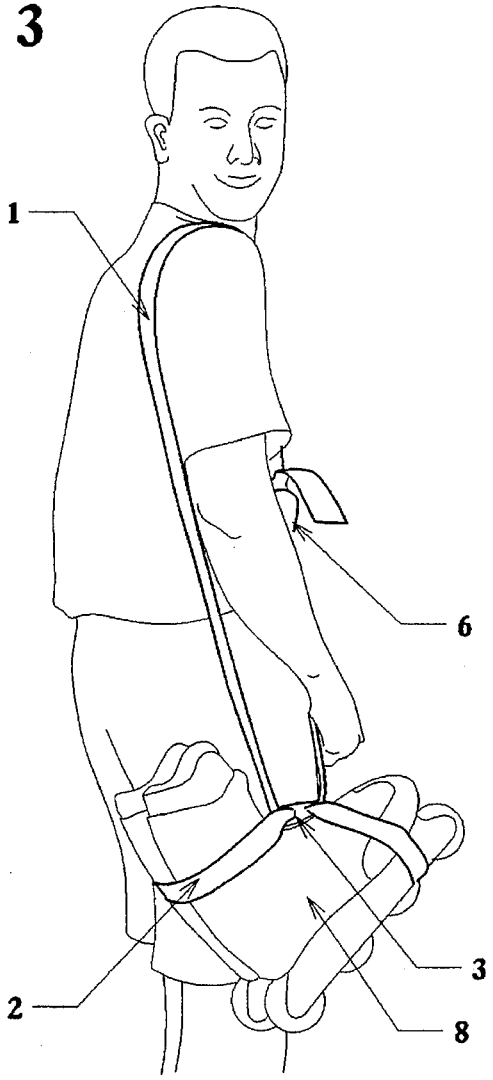
FIG. 4 illustrates the use of the invention as a waistbelt carrying a pair of shoes.

If the user is wearing skates and needs to carry shoes or other waking footwear, the sling 10 can be adapted for this purpose. With the shoes placed sole to sole the loops 31 and 32 are placed around the shoes. Next, loops 31 and 32 are tightened around the shoes by adjusting the length of slack webbing 43 extending from the friction buckle fastener. This arrangement securely holds the shoes to the wide strap 11, which is worn around the waist of the user like a belt as shown in FIG. 4. This positions the shoes in the small of the back freeing up the upper body for quick skating action.

While the invention has been described in detail with reference to preferred embodiments thereof, it will become apparent to those skilled in the art, other embodiments that are within the principle of the invention. The following claims are, therefore, intended to cover and embrace any modifications that remain within the true spirit and scope of the invention.

I claim:

1. An article carrier for carrying footwear having toe and ankle portions, said carrier comprising:

a slotted guide patch having a first side including slotted guide means and a second side;

a first strap having first and second ends, said first end being guided through said slotted guide means in a crisscross manner to thereby form first and second loops in a figure eight configuration, said first loop being closed and defined between said first and second ends of said first strap, and said second loop being open and including said first and second ends of said first strap, said first and second ends of said first strap including an adjustable closure means for closing said second loop wherein said first loop is adapted to wrap around the toe of the footwear and said second loop is adapted to wrap around the ankle portion of the footwear; and a second strap having opposing free ends and passing through both of said first and second loops and directly adjacent said second side, said free ends having an adjustable closure means for attaching together said free ends thereby forming a third loop with an adjustable circumference allowing said second strap to be selectively used as either a shoulder strap or a waist strap for attachment to a user.

2. The carrier of claim 1 wherein said second side of said slotted guide patch is fixed to said first strap.

3. The carrier of claim 1 wherein said first, second, and third loops all lie in different planes when carrying the footwear.

4. The carrier of claim 1 wherein said first and second straps are comprised of webbing.

5. The carrier of claim 1 wherein the width of said second strap is greater than the width of said first strap.

* * * * *